US005571069A

United States Patent [19]

Shah

[11] Patent Number: 5,571,069

[45] Date of Patent: Nov. 5, 1996

[54] PAPER FOLDING ASSEMBLY WITH A CUTTING CYLINDER LAP ADJUSTMENT APPARATUS AND METHOD

[76] Inventor: Chandrakant K. Shah, 7041 Wright Ter., Niles, Ill. 60714

[21] Appl. No.: 73,016

[22] Filed: Jun. 3, 1993

[51] Int. Cl.[6] ..... B65H 45/28; B65H 45/16

[52] U.S. Cl. ..... 493/357; 493/425; 493/432; 493/471; 493/476

[58] Field of Search ..... 493/425, 426, 493/427, 428, 429, 430, 431, 432, 433, 471, 476, 357, 359, 360, 366, 367, 368; 270/20.1, 21.1, 43

[56] References Cited

U.S. PATENT DOCUMENTS

| | | | |
|---|---|---|---|
| 1,784,757 | 12/1930 | Scott | 493/427 |
| 1,831,220 | 11/1931 | Wood | 493/427 |
| 1,969,480 | 8/1934 | Shipley | 493/431 |
| 2,031,780 | 2/1936 | Lamatsch | 493/360 |
| 4,073,485 | 2/1978 | Gregoire | 493/368 |
| 4,917,665 | 4/1990 | Courturier | 493/359 |

*Primary Examiner*—Jack W. Lavinder

[57] ABSTRACT

A paper folding assembly (15) with a plurality of rotatable rollers (18) including a cutting cylinder (60) with a cutting cylinder body (76) mounted for rotation with a rotary drive shaft (66) and having cutting members (84A, 84B) for cutting a paper ribbon (19) into individual paper sheets (24) and folding members (82A, 82B) for creasing the individual sheets (24) into a rotatable jaw cylinder (50) to create a lap (20) between opposed edges (22, 23), a cutting cylinder lap adjustment apparatus (70) with an end plate (62) secured to the folding members (82A, 82B) and mounted to the rotary drive shaft (66) adjacent an end (72) of the cutting cylinder body (76), a plurality of cutting members (84A, 84B) secured to the cutting cylinder body (76) which is mounted for rotary movement around the rotary drive shaft (66) and an adjusting member (90) connected to the cutting cylinder body (76) to move the cutting members (84A, 84B) at different selected angular positions relative to the rotary drive shaft (66) to change the lap (20) without adjusting the synchronized timing between the cutting cylinder body (76) and the jaw cylinder (50).

39 Claims, 9 Drawing Sheets

PAPER FOLDING ASSEMBLY WITH A CUTTING CYLINDER LAP ADJUSTMENT APPARATUS AND METHOD

BACKGROUND OF THE INVENTION

1. Field of the Invention

This invention generally relates to the field of paper folding assemblies of the type employing interacting rotating cylinders and more particularly to such paper folding assemblies having a movable lap adjustment apparatus.

2. Description of the related art including information disclosed under 37 CFR 1.97–1.99

Referring to FIG. 1, paper folding assemblies 15 having a cutting cylinder 30 for separating individual paper sheets from a paper roll 16 received through a train of inking and dampening rollers 18 are well known. It is also known in such assemblies 15 to fold the individual sheets with folding blades or other folding members 46A and 46B located at the cutting cylinder 30 which tuck a portion of paper ribbon 19 into elongate slots 48A and 48B of a jaw cylinder 50.

The folding blades 46A and 46B successively align oppositely with a pair of associated folding slots 48A and 48B, respectively, of the jaw cylinder 50 as the cutting cylinder 30 rotates in the direction of arrow 25 and jaw cylinder 50 rotates in the direction of arrow 27 during operation of the folding assembly 15. When alignment occurs, the folding blades 46A and 46B tuck in a portion of the paper ribbon 19 into an associated one of the folding slots 46A and 46B of the aligned movable jaw cylinder 50. This produces an elongate crease 37, FIG. 3, the paper ribbon 19 at which the ribbon is held within the slot as it is rotated away from the cutting cylinder 30.

Referring to FIGS. 2 and 3, a pair knives or other cutting members 42A and 42B located on opposite sides of the cutting cylinder 30 cut the paper ribbon 19 against a plurality of cutting rubbers 31 equally spaced around the jaw cylinder 50. The cut paper sheet 24 is held at the middle crease, or fold, 37, FIG. 3, with the free edges 22 and 23, FIG. 3, trailing as the folded sheet 24 is carried by continued rotation of the jaw cylinder 50. Since the folding blades 46A and 46B are located midway between the pair of opposed cutting knives 42A and 42B, an even fold results in which the edges 22 and 23, FIG. 3, of the cut sheet 24 are exactly aligned with each other. However, it is often desirable to create a lap 20 between the edges 22 and 23 of the cut and folded sheet 24 in which the edges 22 and 23 of the sheet are not evenly aligned. As seen in FIG. 3, a lap 20 is the difference in length between adjacent free edges 22 and 23 and crease 37 of an unevenly folded sheet 24. The unevenly folded sheet 24 having a lap 20 is divided into two folded sections 26 and 28 of unequal length. One of the folded sections 26 is longer than the other folded section 28 by an amount equal to the lap 20. Frequently, during separation of the paper sheet 24, FIG. 2, pin members 44A and 44B located at the cutting cylinder 30 pierce the sheet 24 at a location proximate to a cut edge 22 in order to stabilize the paper sheet 24 as it is being cut. The overlapping region, or lap, 20, FIG. 3, in the folded section 26 is subsequently trimmed adjacent the other edge 23 to eliminate the pierced section of the sheet and providing an even fold.

In such paper folding assemblies, it is known to provide an apparatus to adjust the length of a lap 20 of a folded paper sheet 24.

Referring to FIG. 4, a cutting cylinder 30 of a known lap adjustment apparatus is shown with the cutting cylinder body 36 press fitted to an elongate drive shaft 32. A pair of clamping bolts 33 and 34 on each side of the cutting cylinder body 36 fasten a pair of end plates 38 and 40 to the cutting cylinder body. Loosening of the clamping bolts 33 and 34 enables the end plates 38 and 40 to freely rotate around the rotary drive shaft 32 of the cutting cylinder 30.

Referring to FIG. 5, the end plate 38 of a known cutting cylinder 30 is shown mounted to the cutting cylinder body 36 by clamping bolt 33 with the cylinder body press fitted to the drive shaft 32. A pair of cutting knives 42A and 42B are mounted at diametrically opposed sides of the cutting cylinder body 36. As the cutting cylinder body 36 rotates about the drive shaft 32, a ribbon of paper 19 received from a train of inking and dampening rollers 18, FIG. 1, is carried to the cutting cylinder 30. The outwardly protruding pin members 44A and 44B pierce the ribbon of paper to stabilize it as the cutting members or knives 42A and 42B cut the paper ribbon into individual sheets. Mounted to the end plate 38, FIG. 5, are a pair of folding blades 46A and 46B located at diametrically opposed sides of the end plate 38. The pair of folding blades 46A and 46B are located midway between each of the adjacent pairs of cutting members 42A and 42B.

In known paper folding assemblies, the pair of folding blades 46A and 46B, FIG. 5, are adjustably moved away from a position spaced midway between the pair of cutting knives 42A and 42B, in order to create an overlapping fold and a lap 20, FIG. 3, on the cut sheet 24, FIG. 3. The end plate 38, FIG. 5, is turned to move both folding blades 46A and 46B to a position in which both blades are closer to one of the cutting knives 42A and 42B and further than the other one of the knives 42A and 42B. Since the folding members 46A and 46B are no longer at a position equidistant from the pair of cutting members 42A and 42B during operation of the folding assembly 15, the crease or fold line 37, FIG. 3, in the cut paper sheet is not located away from the middle of the sheet 24 to create unequal folded sections 26 and 28 and an uneven fold with a lap 20. As seen in FIG. 4, the clamping bolts 33 and 34 in known folding assemblies are loosened on both sides of the cutting cylinder 30 to release the end plates 38 and 40 from the cutting cylinder body 36. The end plates 38 and 40 on each side of the cylinder body 36 are free to rotate around the drive shaft 32 when the clamping bolts 33 and 34 are loosened. An eccentric shaft 52, FIG. 5, is turned to rotate the end plate 38 about the cylinder body to set folding members 46A and 46B relative to the cutting members 42A and 42B to achieve the desired dimensions for the lap 20.

In known paper folding assemblies 15, FIG. 1, since the cutting cylinder body 36 carrying the cutting members 42A and 42B, FIG. 5, is press fitted to the rotary drive shaft 32, both end plates 38 and 40 must be turned about the drive shaft to move the folding blades 46A and 46B relative to the fixed pair of cutting members 42A and 42B in the cylinder body.

The rotation of the cutting cylinder body 36 must be accurately timed relative to the rotation of the jaw cylinder 50 to ensure proper synchronized alignment of the folding blades 46A and 46B of the cutting cylinder 30 with the elongate slots 48A and 48B on the jaw cylinder 50. Disadvantageously, in these known assemblies, the rotating of the folding blades 46A and 46B requires a retiming of the jaw cylinder 50, FIG. 1, relative to the cutting cylinder 30.

The adjustment of a lap length by rotating the folding blades on the cutting cylinder is a lengthy process requiring two persons to retime the jaw and cutting cylinders relative to each other. Alignment of the cylinders requires one operator to set the gears of the cylinders and another operator to measure and set a gage corresponding to the rotational movement of the folding member.

SUMMARY OF THE INVENTION

It is thus the principal object of the present invention to provide a paper folding assembly with a cutting cylinder lap adjustment apparatus and method which eliminates the need to retime the cutting cylinder with the jaw cylinder whatever the lap is adjusted.

This object is achieved by provision of a paper folding assembly, having a plurality of rotatable rollers including a cutting cylinder mounted for rotation with a rotary drive shaft and having a cutting member for cutting a paper ribbon into individual paper sheets and a folding member for creasing the individual sheets into a rotatable jaw cylinder to create a lap between opposed edges of the sheet, with a cutting cylinder lap adjustment apparatus comprising means for mounting the folding member to the rotary shaft and means for mounting the cutting member to the rotary shaft at different selected angular positions on the shaft to change the lap.

Obtainment of the object is achieved by providing a paper folding assembly, having a plurality of rotatable rollers including a cutting cylinder mounted for rotation with a rotary drive shaft and having a cutting member for cutting a paper ribbon into individual paper sheets and a folding member for creasing the individual sheets into a rotatable jaw cylinder to create a lap between opposed edges of the sheet, with a cutting cylinder lap adjustment assembly comprising means for mounting the folding member in a fixed angular position on the rotary drive shaft and means for mounting the cutting member for movement relative to the folding member to change the lap.

Also, the object of the invention is obtained by provision of a method of adjusting the lap in a paper folding assembly having a plurality of rotatable rollers including a cutting cylinder mounted for rotation with a rotary drive shaft and having a cutting member for cutting a paper ribbon into individual paper sheets and a folding member for creasing the individual sheets into a rotatable jaw cylinder to create a lap between opposed edges of the sheets comprising the steps of (a) moving the cutting member to selected different angular positions relative to the rotary drive shaft and (b) holding the folding member in a fixed angular position on the rotary drive shaft as the cutting member is moved to different positions.

BRIEF DESCRIPTION OF THE DRAWINGS

The foregoing objects and advantageous features of the invention will be explained in greater detail and others will be made apparent from the detailed description of the preferred embodiment of the present invention which is given with reference to the several figures of the drawing, in which.

DESCRIPTION OF THE PREFERRED EMBODIMENT

Figure 6:
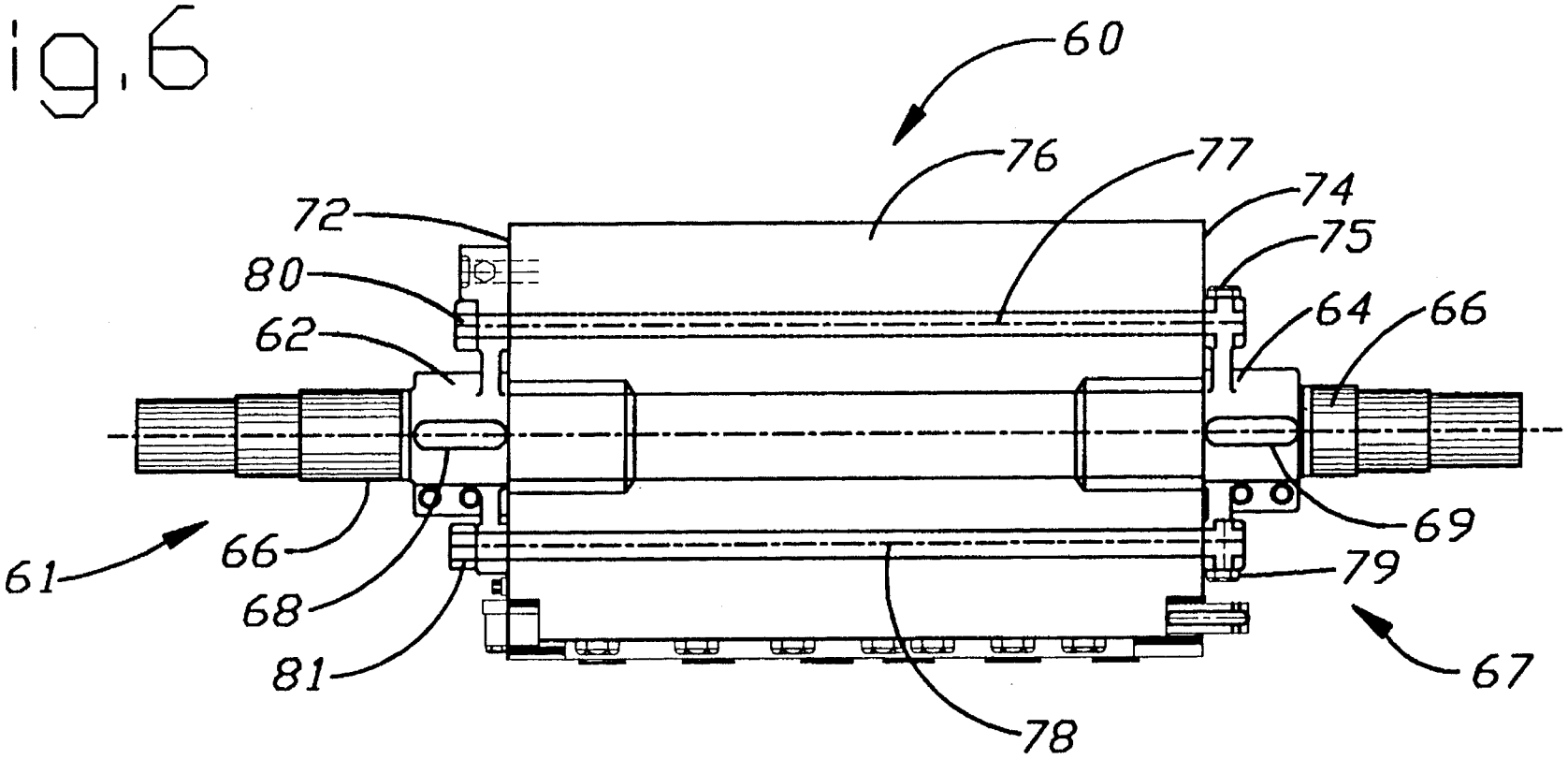
FIG. 6 is front view of the preferred embodiment of the cutting cylinder of the present invention.

Referring to FIG. 6, the preferred embodiment of the cutting cylinder 60 of the present invention is shown with end plates 62 and 64 keyed to the drive shaft 66. The end plates 62 and 64 are slidably mounted onto key members 68 and 69 located on the drive shaft 66. The end plates 62 and 64 are slid through the key members 68 and 69 and are turned into a locking relationship with the drive shaft 66 at a position adjacent the ends 72 and 74 of the cutting cylinder body 76. A pair of tie rods 77 and 78 extend between the pair of end plates 62 and 64 through the cutting cylinder body 76. The tie rods 77 and 78 are permanently fixed by threaded clamp screws 75 and 79 to end plate 64 at the back end 67 of the cutting cylinder 70. A pair of fastener members 80 and 81 fasten end plate 62 to the cutting cylinder body 76 at the nose end 61 of the cutting cylinder 70. The pair of fastener members 80 and 81 is releasably secured to the pair of corresponding tie rods 77 and 78 to tightly fit and connect end plate 62 to the side 72 of the cutting cylinder body 76. Unlike the cutting cylinder 30 of the prior art, the cutting cylinder body 76 of the present invention is not press fitted to the drive shaft 66. The cutting cylinder body 76 is therefore free to rotate around the drive shaft 66 when the clamping nut fastener members 80 and 81 are loosened. Loosening of the fastener members 80 and 81 releases the securement of the end plate 62 against an end 72 of the cutting cylinder body 76 to enable the cutting cylinder body 76 to rotate around the drive shaft 66.

Figure 1:
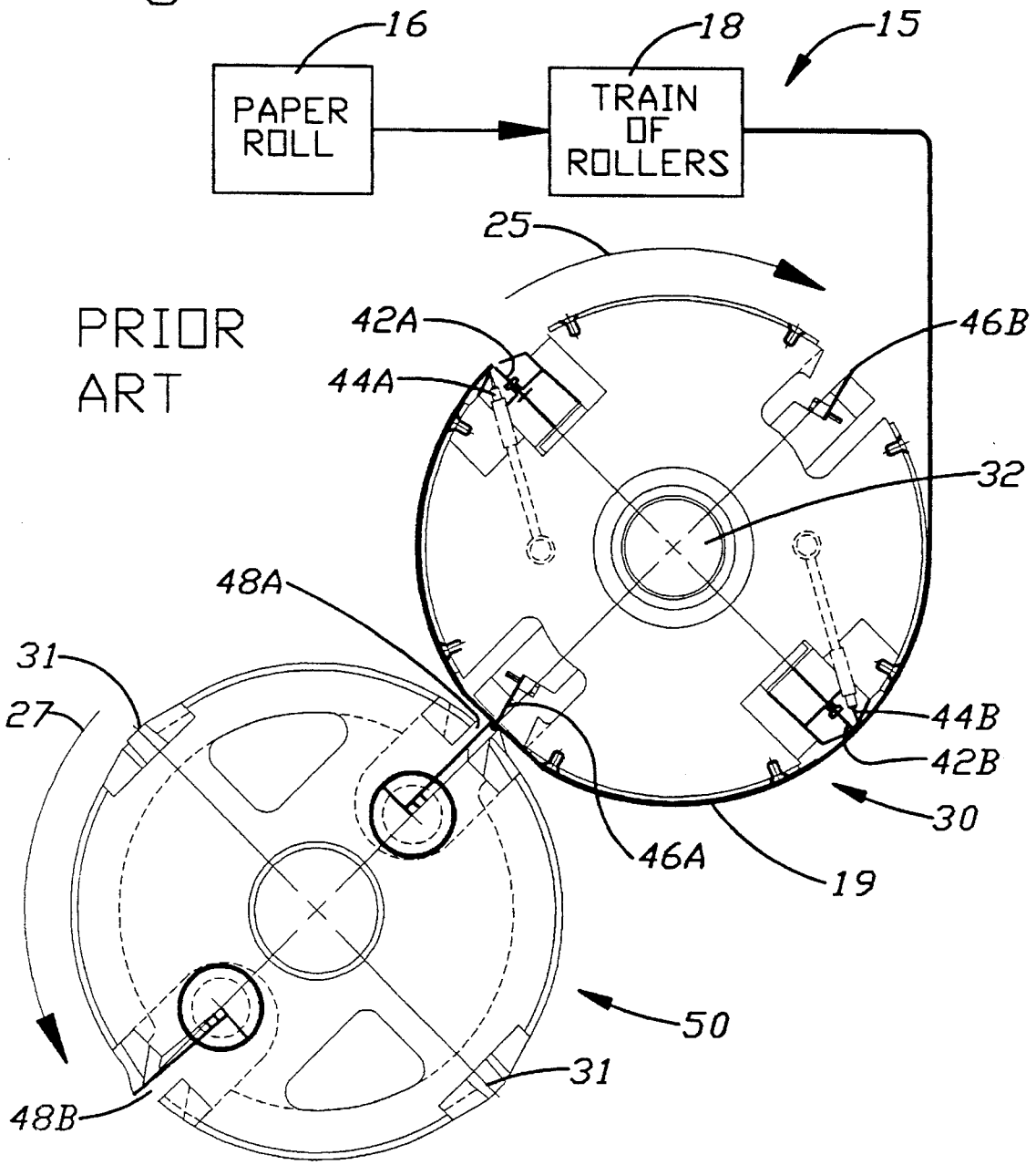
FIG. 1 is a schematic end view of a conventional paper folding assembly of the PRIOR ART illustrating the folding operation of a cutting cylinder-with an aligned jaw cylinder.
Figure 2:
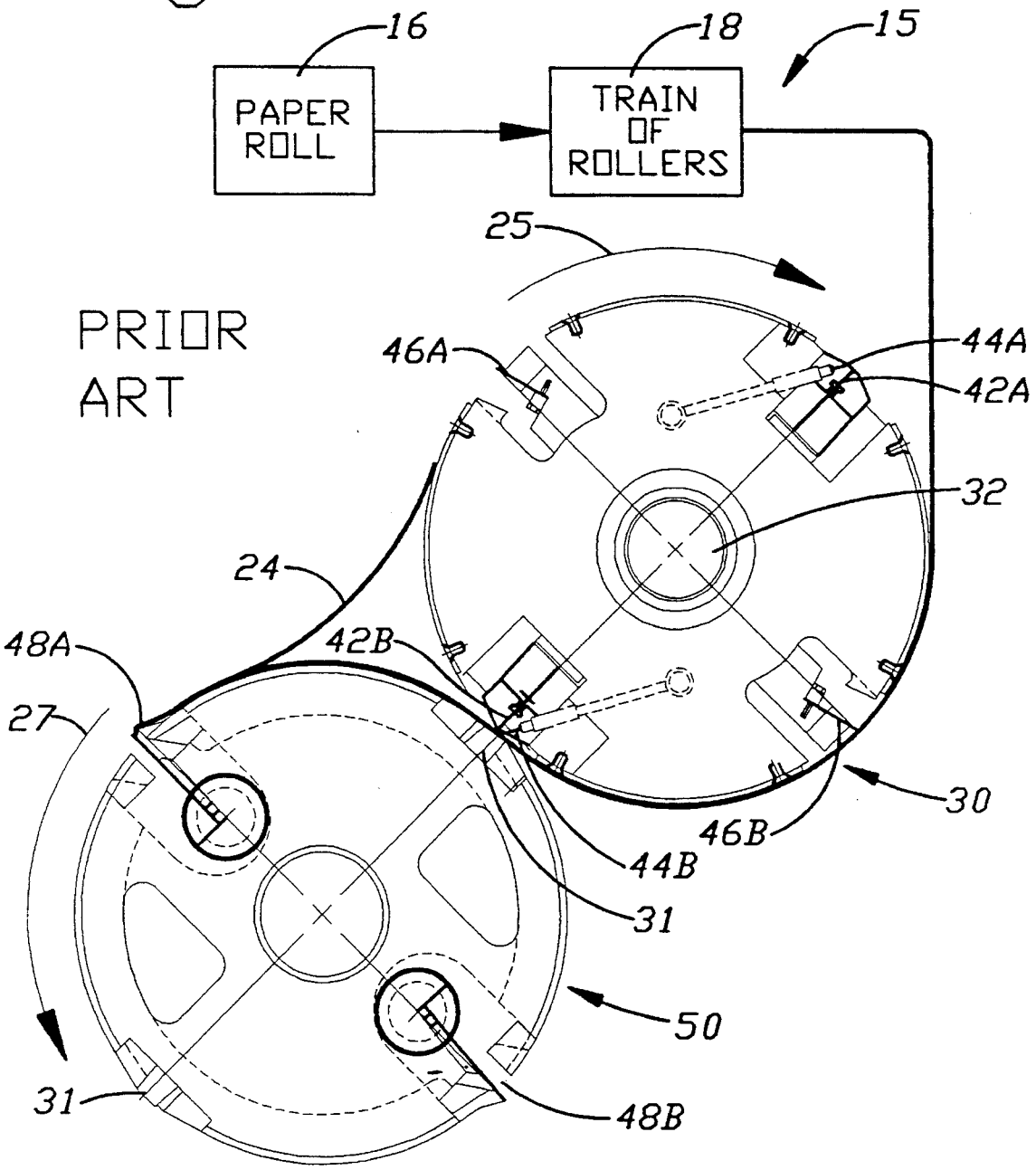
FIG. 2 is a schematic end view of a conventional paper folding assembly of the PRIOR ART illustrating the cutting of a paper ribbon into an individual folded sheet.
Figure 3:
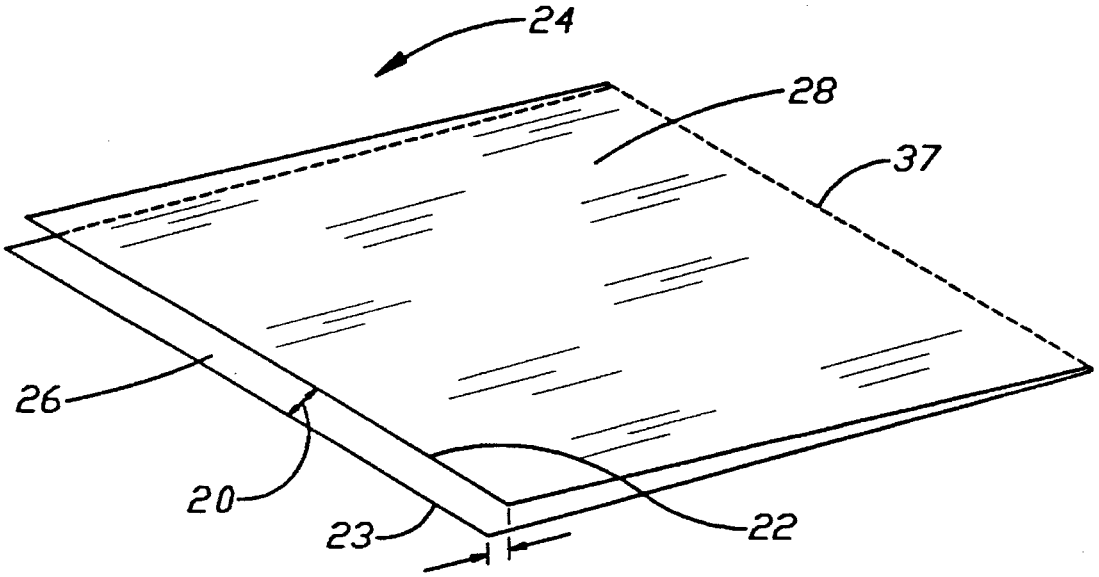
Fig.3 PRIOR ART
FIG. 3 is a prospective view of a folded paper sheet of the PRIOR ART illustrating a lap.
Figure 4:
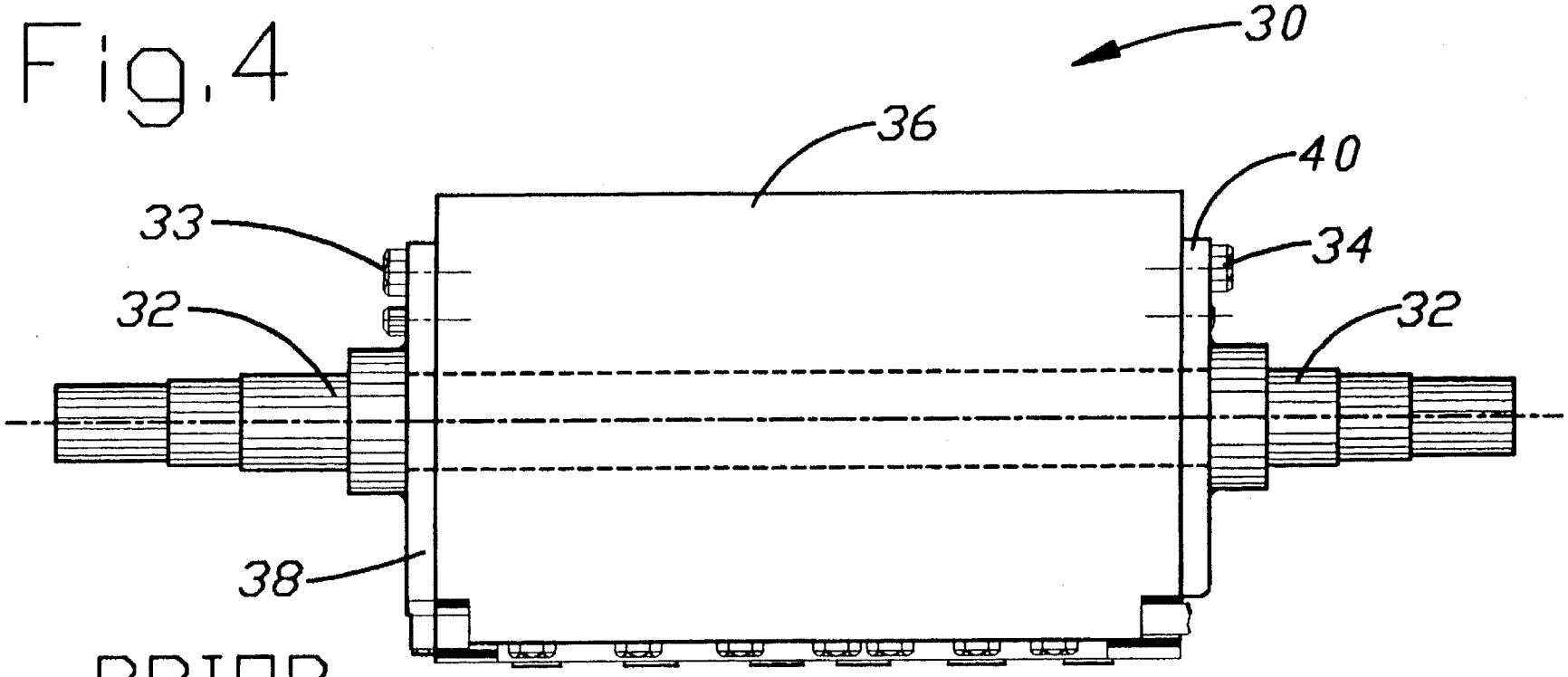
Fig. 4 PRIOR ART
FIG. 4 is a front view of a conventional cutting cylinder of the PRIOR ART.
Figure 5:
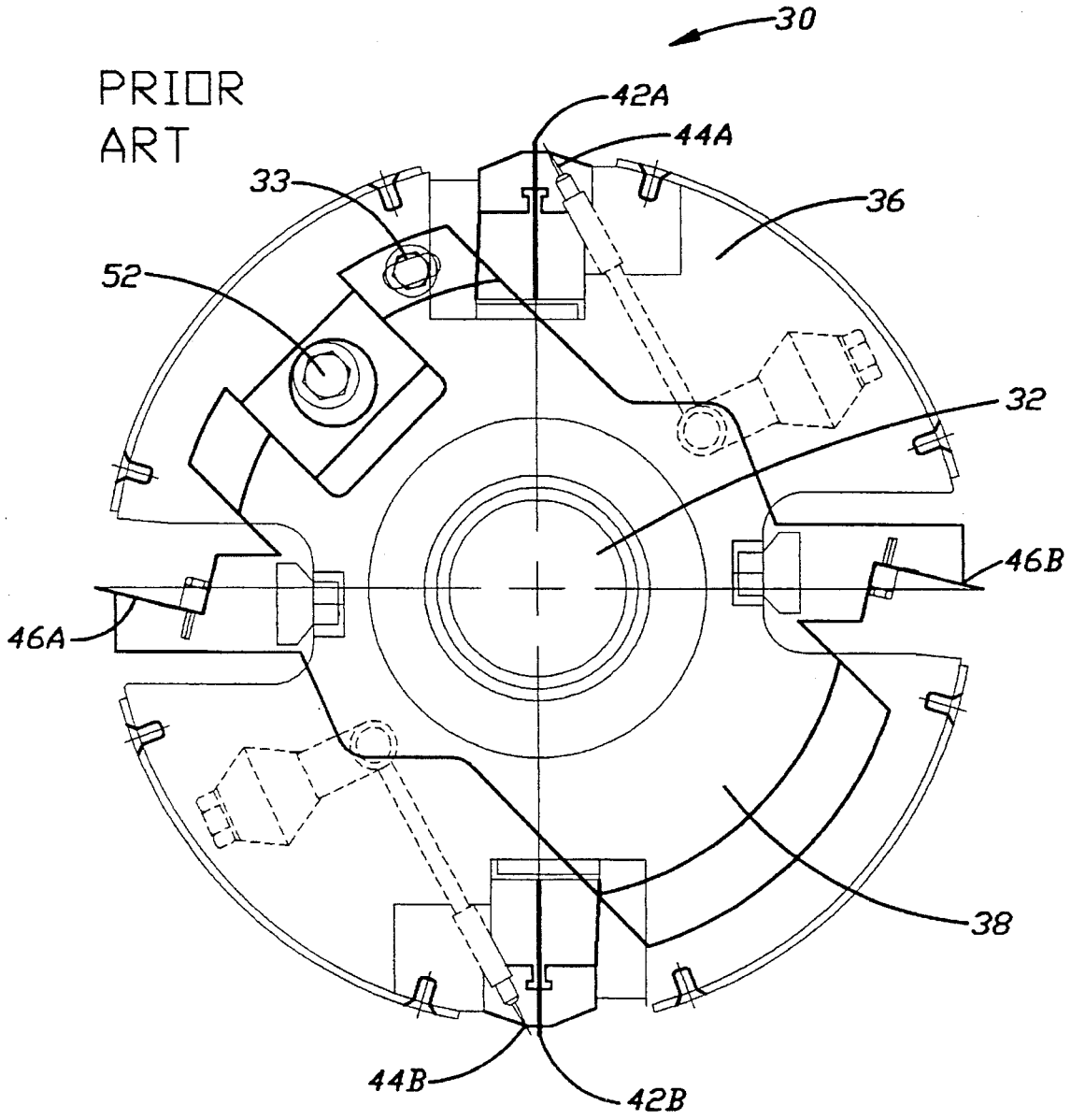
FIG. 5 is an end view of the conventional cutting cylinder of FIG. 4 of the PRIOR ART.
Figure 7:
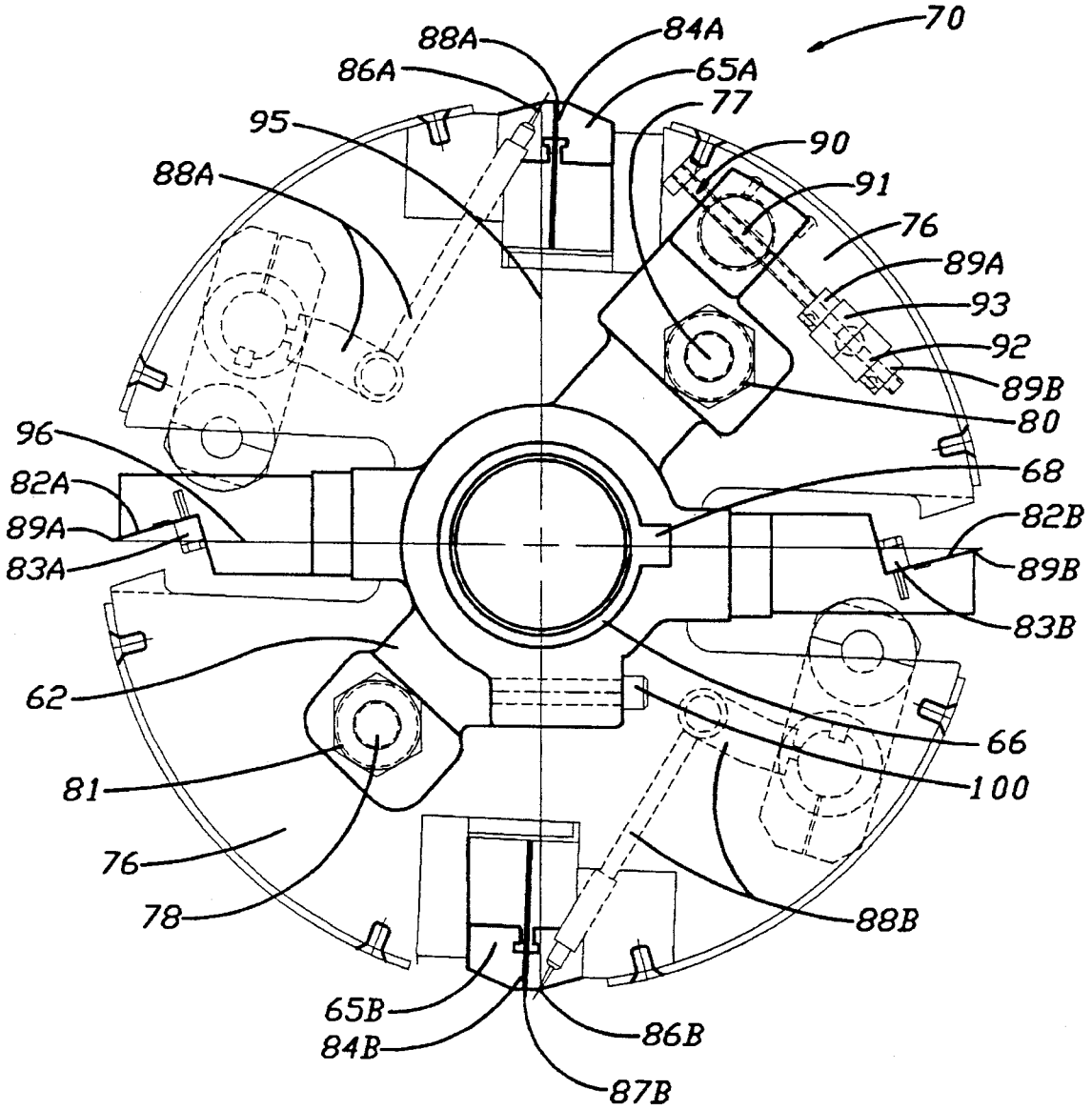
FIG. 7 is a nose end view of the preferred embodiment of the cutting cylinder of FIG. 6 illustrating the cutting cylinder lap adjustment apparatus of the present invention in an even fold position.

Referring to FIG. 7, a pair of folding blades 82A and 82B of the cutting cylinder lap adjustment apparatus 70 is mounted by attaching members 83A and 83B at diametrically opposed peripheral positions on the circular end plate 62. The end plate 62 carries the folding members 82A and 82B and, in turn, is mounted to the rotary drive shaft 66. A pair of cutting members 84A and 84B is held in the cutting cylinder body 76 by wedge clamps 65A and 65B at diametrically opposed ends. Pin members 86A and 86B are connected to linkages 88A and 88B respectively in the cutting cylinder body 76 for movement to pierce and stabilize a paper ribbon 24 as described in FIGS. 1 and 2. As seen in FIG. 7, the pair of folding members 82A and 82B is located midway between the pair of opposed cutting members 84A and 84B about the circumference of the cutting cylinder body 76. A ninety degree angle exists between each folding blade member and each cutting knife member. In the position shown in FIG. 7, an even fold with no lap 20 in a cut and folded sheet 24 is established, since both folding blade members 82A and 82B are equidistant from both cutting knife members 84A and 84B. A lap 20 is created in a folded sheet 24 by changing the relationship between the tips 89A and 89B of the folding blade members 82A and 82B to the tips 87A and 87B of the cutting members 84A and 84B.

In the preferred embodiment, the cutting cylinder body 76 is rotated around the drive shaft 66 to move the pair of cutting knife members 84A and 84B to different selected angular positions to change the length of a lap 20. Unlike the lap adjustment assemblies of the prior art shown in FIGS. 1–5, the folding blade members 82A and 82B of the present invention remain stationary during movement of the cutting knife members 84A and 84B to change the relative spacing between the knives and blades. As seen in FIG. 6, the pair of fastener members nuts 80 and 81 fasten the end plate 62 to the cutting cylinder body 76. The end plate 62 is secured to the drive shaft through key member 68. The end plate 62, FIG. 7, is slidably placed over the key member 68 and is turned to lock the end plate in place on the rotary drive shaft 66. The cutting cylinder body 76 is released from abutment against the end plate 62 by the loosening of the clamping nuts 80 and 81 to enable the cutting cylinder to freely rotate around the drive shaft 66.

An adjusting member 90 secured to both the end plate 62 and the cutting cylinder body 76 is used to rotate the cutting cylinder body around the drive shaft 66. The elongate screw shaft 91 of the adjusting member 90 is threaded through the fixed end plate 62, and an end 92 of the screw shaft is connected by a pair of clamp collars 89A and 89B on opposite sides of a trunnion pin 93 to the cutting cylinder body 76. Movement of the adjusting member 90 rotates the cutting cylinder body 76 around the drive shaft 66 when the fastening members 80 and 81 are loosened from the tie rods 77 and 78.

Figure 8:
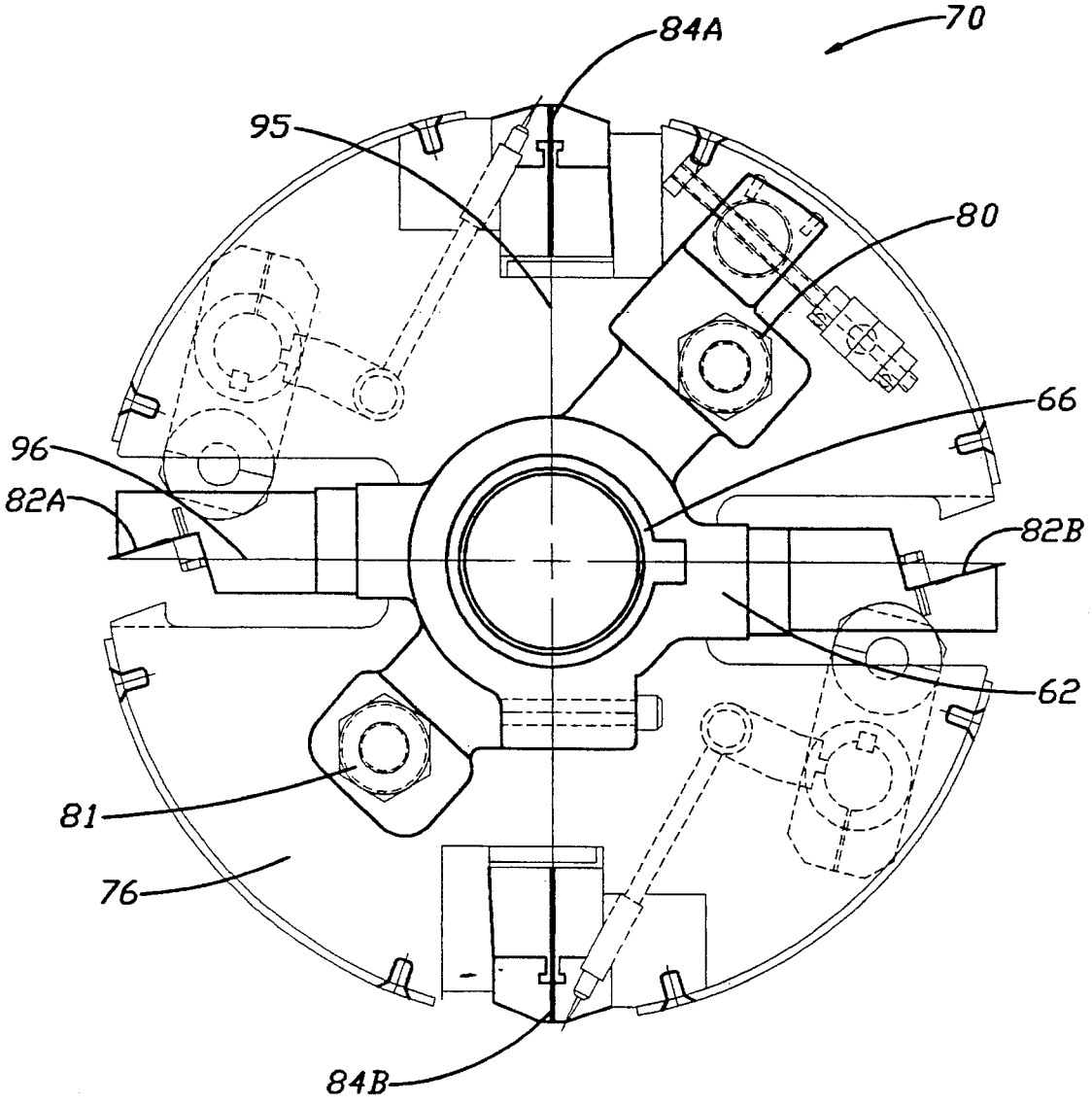
FIG. 8 is a nose end view of the preferred embodiment of the cutting cylinder of FIG. 6 like that of FIG. 7 but illustrating the cutting cylinder lap adjustment apparatus in an adjusted lap fold position.

Referring to FIG. 8, the cutting cylinder lap adjustment assembly 70 is shown in the adjusted position with the cutting members 84A and 84B mounted in a different angular position relative to the folding members 82A and 82B to change the lap. The cutting cylinder body 76 carrying cutting members 84A and 84B is shown rotated in a clockwise direction off the vertical axis line 95. The folding members 82A and 82B secured by attaching members 83A and 83B to the end plate 62 remain mounted in a fixed angular position relative to the rotary drive shaft 66. The folding members 82A and 82B are held stationary along horizontal axis line 96 as the cutting members 84A and 84B are adjusted. The fastener members 80 and 81 are tightened around the tie rods 77 and 78 to secure the end plate 62 to the end 72 of the cutting cylinder body 76. Since the folding members 82A and 82B are not located midway between the pair of cutting members 84A and 84B, an uneven fold and thus a lap 20 in a cut sheet 24 results. As seen in FIG. 8, cutting member 84A is moved further while cutting member 84B is moved closer to folding member 82A in the adjusted position than in the even fold position of FIG. 7. Thus, the folded sheet section between cutting member 84A and folding member 82A is longer than the sheet section between cutting member 84B and folding member 82A. Adjusting the lap 20 without moving the folding members 82A and 82B eliminates the need to retime the jaw cylinder relative to the cutting cylinder.

Figure 9:
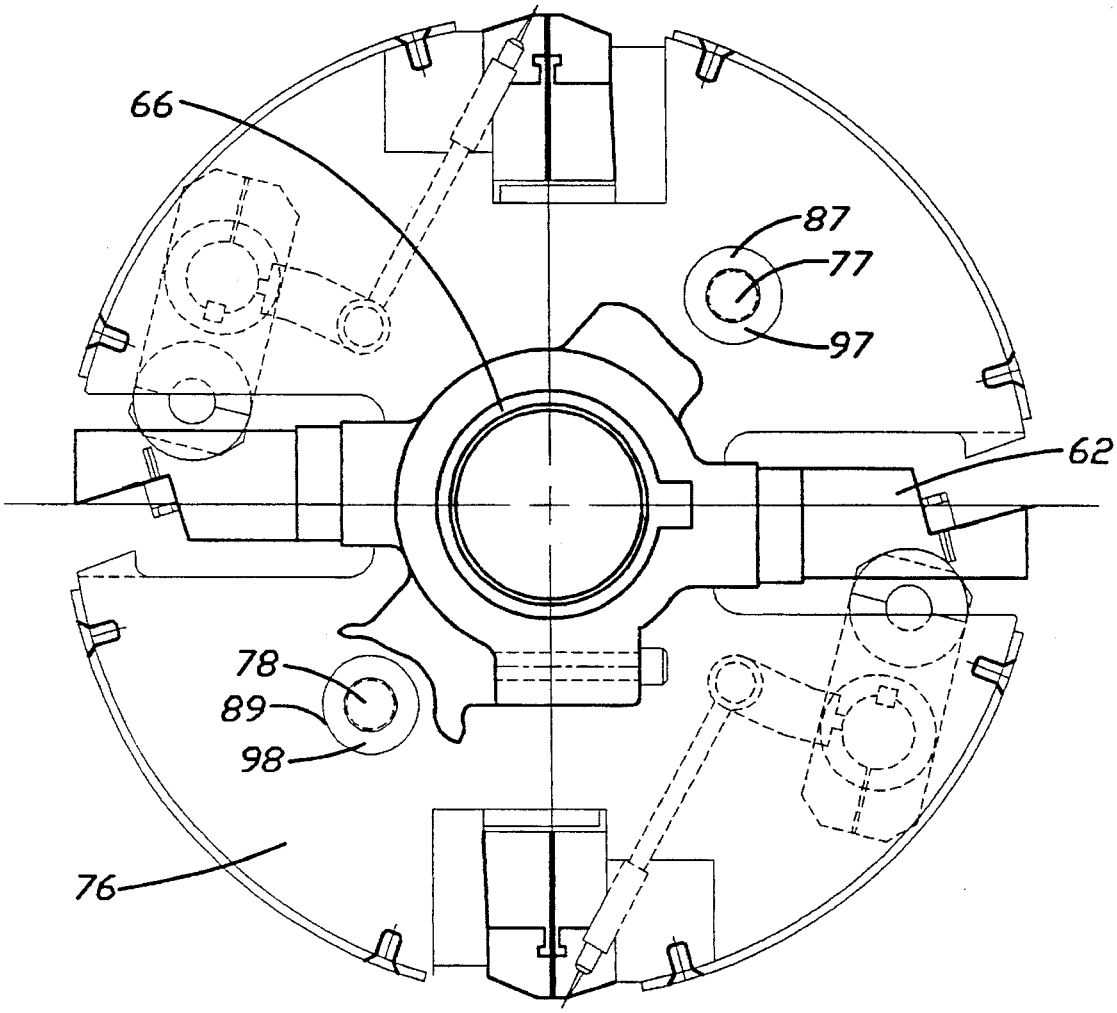
FIG. 9 is a nose end view of the preferred embodiment of the cutting cylinder of FIG. 6 with the end plate partially removed.

Referring to FIG. 9, the tie rods 77 and 78 pass through bores 97 and 98 which extend through the cutting cylinder body 76. The interior walls 87 and 89 of the cutting cylinder body 76 also have bores 97 and 98 through which tie rods 77 and 78 are inserted. The bores 97 and 98 each have a diameter greater than the diameters their corresponding tie rods 77 and 78. The wider bores 97 and 98 enable the cutting cylinder body 76 to freely rotate around the drive shaft 66 when moved to a lap adjusted position. After the fastener members 80 and 81, FIG. 7, are loosened, the tie rods 77 and 78 are free to move within the elongate bores 97 and 98 in response to movement of the adjusting member 90.

While the advantages of the invention are preferably obtained with the cutting cylinder lap adjustment assembly 70 described above with reference to FIGS. 6–9, the method of the present invention can be practiced with any other paper folding apparatus having a plurality of rotatable rollers including a cutting cylinder mounted for rotation with a rotary drive shaft and having a cutting member for cutting a paper ribbon into individual paper sheets and a folding member for creasing the individual sheets into a rotatable jaw cylinder to create a lap between opposed edges of the sheets. Preferably, the cutting cylinder lap assembly is adjusted by (1) mounting the folding member to the rotary drive shaft, (2) moving the cutting member to selected different angular positions relative to the rotary drive shaft, and (3) holding the folding member in a fixed position as the cutting member is moved to different positions.

In the preferred embodiment, the cutting members 84A and 84B, FIG. 7, are mounted in the cutting cylinder body 76 by wedge clamps 65A and 65B. The cutting cylinder body is rotated around the rotary drive shaft 66 to rotate the cutting member around the drive shaft. An adjustment screw 90 having an elongate shaft 91 is threaded through an end plate 62 that is fixed to the rotary drive shaft 66. The end plate is mounted adjacent an end 72 of the cutting cylinder body 76. The adjustment screw 90 has an end 92 connected to the cutting cylinder body 76 by securing plate 93. Preferably, the adjustment screw 90 is turned through the threaded portion of the fixed end plate 62 to move the cutting cylinder body 76 around the rotary drive shaft 66.

The step of holding the folding members 82A and 82B in a fixed position while the cutting members 84A and 84B are moved is performed by mounting the folding members to the end plate 62. Attaching members 83A and 83B secure the folding members 82A and 82B to the end plate 62. The end plate 62 is secured to the rotary drive shaft 66 by keying the end plate to the drive shaft to maintain the folding members 84A and 84B in a fixed position. End plate 62 is inserted through the key member 68 on the rotary drive shaft to lock the plate in a fixed position on the drive shaft. Axial locking is achieved by locking screw 100, FIG. 7.

A pair of fastener members 80 and 81 secure the end plate 62 against the end 72 of the cutting cylinder body 76. As seen in FIG. 6, elongate tie rods 77 and 78 extend through the cutting cylinder body 76 and end plate 62. Threaded clamp screws 75 and 79 attached through tie rods 77 and 78 permanently secure the other end plate 64 to the other end 74 of the cutting cylinder body 76. Fastening members 80 and 81 releasably secure the end plate 62 against the cutting cylinder body 76. Adjusting the lap 20 of a sheet 24 of paper requires the step of loosening the fastening members 80 and 81 from the tie rods 77 and 78 to release the end plate 62 against securement of the end 72 of the cutting cylinder body 76. Releasing of the end plate 62 against the cutting cylinder body 76 enables the cylinder body to freely rotate around the drive shaft 66.

The step of moving the adjustment screw 90 is performed to move the cutting members 84A and 84B connected to the cylinder body 76 relative to the stationary folding members 82A and 82B until the desired lap adjustment is achieved. The step of securing the fastener members 80 and 81 through tie rods 72 and 78 to abut the end plate 62 against the end 72 of the cutting cylinder body 76 is performed once the cutting cylinder body is rotated around the rotary drive shaft 66 to the desired positions. Thus, in the present invention, adjusting the length of a lap 20 is achieved without moving the position of the folding members to eliminate the need to retime synchronized movement of the jaw cylinder relative to the cutting cylinder.

While a detailed description of the preferred embodiment of the invention has been given, it should be appreciated that many variations can be made thereto without departing from the scope of the invention as set forth in the appended claims.

I claim:

1. In a paper folding assembly having a plurality of rotatable rollers including a cutting cylinder mounted for rotation with a rotary drive shaft and having a cutting member for cutting a paper ribbon into individual paper sheets and a folding member for creasing the individual sheets into a rotatable jaw cylinder to create a lap between opposed edges of the sheet, the improvement being a cutting cylinder lap adjustment apparatus, comprising:

means for mounting the folding member to the rotary shaft including
an end plate, means for mounting the folding member to the end plate, and means for securing the end plate to the rotary drive shaft; and means for mounting the cutting member to the rotary shaft at different selected angular positions on the shaft to change the lap.

2. The paper folding assembly of claim 1 in which the securing means includes means for keying the end plate to the rotary shaft to fix end plate to the rotary shaft.

3. In a paper folding assembly having a plurality of rotatable rollers including a cutting cylinder mounted for rotation with a rotary drive shaft and having a cutting member for cutting a paper ribbon into individual paper sheets and a folding member for creasing the individual sheets into a rotatable jaw cylinder to create a lap between opposed edges of the sheet, the improvement being a cutting cylinder lap adjustment apparatus, comprising:

means for mounting the folding member to the rotary shaft; and means for mounting the cutting member to the rotary shaft at different selected angular positions on the shaft to change the lap including
a cutting cylinder body, and
means for securing the cutting member in the cutting cylinder body.

4. The paper folding assembly of claim 3 in which the cutting member mounting means includes means for rotating the cutting cylinder body around the rotary drive shaft.

5. The paper folding assembly of claim 4 in which the rotating means includes an end plate fixed to the rotary drive shaft and mounted adjacent an end of the cutting cylinder body, and an adjusting member having an elongate screw shaft threaded through the fixed end plate and connected to the cutting cylinder body.

6. The paper folding assembly of claim 4 including an end plate fixed to the rotary drive shaft, and mounted adjacent an end of the cutting cylinder body, and means for fastening the end plate to the end of the cutting cylinder body.

7. The paper folding assembly of claim 6 including means for securing the folding member to the end plate.

8. The paper folding assembly of claim 7 in which the fastening means includes means defining a bore through the cutting cylinder body, a tie rod inserted through the bore and the end plate, and a fastener mounted about the tie rod adjacent the end plate to releasably secure the end plate to the cutting cylinder body.

9. The paper folding assembly of claim 8 in which the bore has a diameter greater than the diameter of the tie rod.

10. The paper folding assembly of claim 9 in which the cutting cylinder body rotating means includes an adjusting member having an elongate screw shaft threaded through a portion of the fixed end plate, and in which the screw shaft is connected to the cutting cylinder body.

11. The paper folding assembly of claim 8 including another end plate mounted adjacent another end of the cutting cylinder body, and means for securing the other end plate to the other end of the cutting cylinder body, and in which the elongate tie rod extends through the other end of the cutting cylinder body to the other end plate.

12. The paper folding assembly of claim 7 in which the folding member includes a pair of folding blades secured to the end plate at diametrically opposed locations.

13. The paper folding assembly of claim 12 including another cutting member mounted at a diametrically opposed location on the cutting cylinder body relative to the cutting member.

14. In a paper folding assembly having a plurality of rotatable rollers including a cutting cylinder mounted for rotation with a rotary drive shaft and having a cutting member for cutting a paper ribbon into individual paper sheets and a folding member for creasing the individual sheets into a rotatable jaw cylinder to create a lap between opposed edges of the sheet, the improvement being a cutting cylinder lap adjustment assembly, comprising:

means for mounting the folding member in a fixed angular position on the rotary drive shaft; including
an end plate, means for mounting the folding member to the end plate;

means for securing the end plate to the rotary drive shaft; and means for mounting the cutting member for movement relative to the folding member to change the lap.

15. The paper folding apparatus of claim 14 in which the securing means includes means for keying the end plate to the rotary shaft to secure the end plate in a fixed position on the rotary drive shaft.

16. In a paper folding assembly having a plurality of rotatable rollers including a cutting cylinder mounted for rotation with a rotary drive shaft and having a cutting member for cutting a paper ribbon into individual paper sheets and a folding member for creasing the individual sheets into a rotatable jaw cylinder to create a lap between opposed edges of the sheet, the improvement being a cutting cylinder lap adjustment assembly, comprising:

means for mounting the folding member in a fixed angular position on the rotary drive shaft; and means for mounting the cutting member for movement relative to the folding member to change the lap including a cutting cylinder body, and means for securing the cutting member in the cutting cylinder body.

17. The paper folding assembly of claim 16 in which the cutting member mounting means includes means for rotating the cutting cylinder body around the rotary drive shaft.

18. The paper folding assembly of claim 17 in which the rotating means includes an end plate fixed to the rotary drive shaft and mounted adjacent an end of the cutting cylinder body, and an adjusting member secured to the end plate and the cutting cylinder body.

19. The paper folding assembly of claim 18 in which the adjusting member includes an elongate screw shaft threaded through the fixed end plate and connected to the cutting cylinder body.

20. The paper folding assembly of claim 17 including an end plate fixed to the rotary drive shaft and mounted adjacent an end of the cutting cylinder body, and means for fastening the end plate to the end of the cutting cylinder body.

21. The paper folding assembly of claim 20 in which the fastening means includes means defining a bore through the cutting cylinder body, a tie rod inserted through the bore and the end plate, and a clamping nut mounted about the tie rod adjacent the end plate to releasably secure the end plate to the cutting cylinder body.

22. The paper folding assembly of claim 21 in which the bore has a diameter greater than the diameter of the tie rod.

23. The paper folding assembly of claim 21 including means for securing the folding member to the end plate.

24. The paper folding assembly of claim 21 in which the cutting cylinder body rotating means includes an adjusting member secured to the cutting cylinder body and slidably mounted to the end plate.

25. The paper folding assembly of claim 24 in which the adjusting member includes an elongate screw shaft fixed to the cutting cylinder body and threaded through the end plate.

26. The paper folding assembly of claim 24 including another end plate mounted adjacent another end of the cutting cylinder body in which the tie rod extends through the end of the cutting cylinder body to the other end plate, and means for securing the other end plate to the other end of the cutting cylinder body.

27. The paper folding assembly of claim 20 including another folding member secured at a diametrically opposed location relative to the folding member on the end plate.

28. The paper folding assembly of claim 27 including another cutting member mounted at a diametrically opposed location on the cutting cylinder body relative to the cutting member.

29. In a paper folding assembly having a plurality of rotatable rollers including a cutting cylinder mounted for rotation with a rotary drive shaft and having a cutting member for cutting a paper ribbon into individual paper sheets and a folding member for creasing the individual sheets into a rotatable jaw cylinder to create a lap between opposed edges of the sheets, the improvement being a method of adjusting the lap, comprising the steps of:

moving the cutting member to selected different angular positions relative to the rotary drive shaft; and holding the folding member in a fixed angular position on the rotary drive shaft as the cutting member is moved to different positions to change the length of the lap.

30. The method of claim 29 in which the step of moving the cutting member includes the step of rotating the cutting member around the rotary drive shaft.

31. The method of claim 30 in which the step of moving the cutting member includes the steps of mounting the cutting member to a cutting cylinder body, and rotating the cutting cylinder body around the rotary drive shaft.

32. The method of claim 31 in which the step of rotating the cutting cylinder includes the step of moving an adjusting member connected to the cutting cylinder body.

33. The method of claim 32 in which the adjusting member is moved by threading it through an end plate fixed to the rotary drive shaft and mounted adjacent an end of the cutting cylinder body.

34. The method of claim 31 in which step of holding the folding member includes the steps of mounting the folding member to an end plate, and securing the end plate to the rotary draft shaft at a position adjacent an end of the cutting cylinder body.

35. The method of claim 34 in which the step of securing the end plate includes the step of keying the end plate to the rotary drive shaft.

36. The method of claim 34 including the step of releasing the end plate against securement to the end of the cutting cylinder.

37. The method of claim 36 in which the step of releasing the end plates includes the step of loosening a fastener member adjacent the end plate to allow the cutting cylinder body to rotate around the rotary drive shaft.

38. The method of claim 37 in which the step of rotating the cutting cylinder includes moving an adjusting member connected to the cutting cylinder body.

39. The method of claim 38 including the step of securing the fastener member to the end plate to abut the end plate against the end of the cutting cylinder body.

* * * * *